US005354125A

United States Patent [19]

Desanta

[11] Patent Number: 5,354,125

[45] Date of Patent: Oct. 11, 1994

[54] SHELF KIT

[75] Inventor: Simon Desanta, Borgholzhausen, Fed. Rep. of Germany

[73] Assignee: Flötotto Einrichtungssysteme GmbH & Co.KG, Gütersloh, Fed. Rep. of Germany

[21] Appl. No.: 2,388

[22] Filed: Jan. 11, 1993

[30] Foreign Application Priority Data

Jan. 9, 1992 [DE] Fed. Rep. of Germany ..... 4200338

[51] Int. Cl.[5] ..... A47B 47/00; A47B 57/00

[52] U.S. Cl. ..... 312/109; 312/111; 312/265; 312/265.6

[58] Field of Search ..... 312/107, 108, 109, 111, 312/257.1, 263, 265, 265.5, 265.6, 293.1, 293.2, 293.3; 211/187, 186, 90

[56] References Cited

U.S. PATENT DOCUMENTS

| | | | |
|---|---|---|---|
| 893,983 | 7/1908 | Chilstrom | 312/286 X |
| 3,896,743 | 7/1975 | Pariente | 211/186 X |
| 3,926,483 | 12/1975 | Hentrich | 312/107 |
| 4,153,311 | 5/1979 | Takahashi et al. | 312/265.5 X |
| 4,384,751 | 5/1983 | Guntermann et al. | 312/107 |
| 5,009,042 | 4/1991 | Sacco et al. | 211/187 X |
| 5,176,435 | 1/1993 | Pipkens | 312/265.6 X |

*Primary Examiner*—Kenneth J. Dorner
*Assistant Examiner*—Nancy Mulcare
*Attorney, Agent, or Firm*—Spencer, Frank & Schneider

[57] ABSTRACT

A shelf kit for producing a shelf arrangement includes a number of vertical upright members and a number of compartment bases for forming shelf compartments. The upright members are composed of a plurality of upright segments, each taking up approximately the height of a shelf compartment. The compartment bases are longer than the width of a shelf compartment. The front and rear regions of the upright segments, where they project beyond the compartment bases, are provided with vertical passages into which vertical rods can be inserted which extend over the height of the shelf arrangement.

6 Claims, 4 Drawing Sheets

SHELF KIT

CROSS REFERENCE TO RELATED APPLICATION

This application claims the priority of application Ser. No. P 42 00 338.5, filed Jan. 9, 1992, in the Federal Republic of Germany, the subject matter of which is incorporated herein by reference.

BACKGROUND OF THE INVENTION

The present invention relates to a shelf kit for the production of a shelf arrangement including a number of vertical upright members and a number of compartment bases for the formation of shelf compartments.

SUMMARY OF THE INVENTION

It is an object of the present invention to provide a shelf kit for a shelf system which is easily and variably installed without the use of tools.

This is accomplished according to the invention in that the upright members are composed of a plurality of upright segments each taking up the height of a shelf compartment; the compartment bases are longer than the width of a shelf compartment; and the upright segments, in their front and rear end regions projecting beyond the compartment bases, are provided with vertical passages into which rods can be inserted that extend vertically over the height of the shelf arrangement.

In conventional shelf arrangements, the vertical upright members usually constitute continuous components while the compartment bases are inserted individually. In the present invention, this principle is reversed. The compartment bases extend at least over several compartments while the upright segments support the successive compartment base boards against one another. The rods inserted into the vertical edges of the upright segments serve to hold the upright segments in the vertical position and to stabilize the shelf arrangement as a whole.

Preferably, spacers are provided which are pushed onto the rods between pairs of upright segments and take up the height of a compartment base.

While most times the upright segments have the height of a shelf compartment, they may also be subdivided into strip-like configurations which may also be provided, for example, alternatingly with spacers so that the upright segments as a whole form a type of lath grid.

It has already been pointed out that spacers of the height of the compartment bases are disposed on the rods between the upright segments. Instead of the spacers, other components may also be hooked in at this location, for example doors to close off individual shelf compartments. All statements such as "top", "bottom", etc. refer to the finished, assembled shelf arrangement.

BRIEF DESCRIPTION OF THE DRAWINGS

Preferred embodiments of the invention will now be described in greater detail with reference to the attached drawings, in which.

DETAILED DESCRIPTION OF THE PREFERRED EMBODIMENTS

Figure 1:
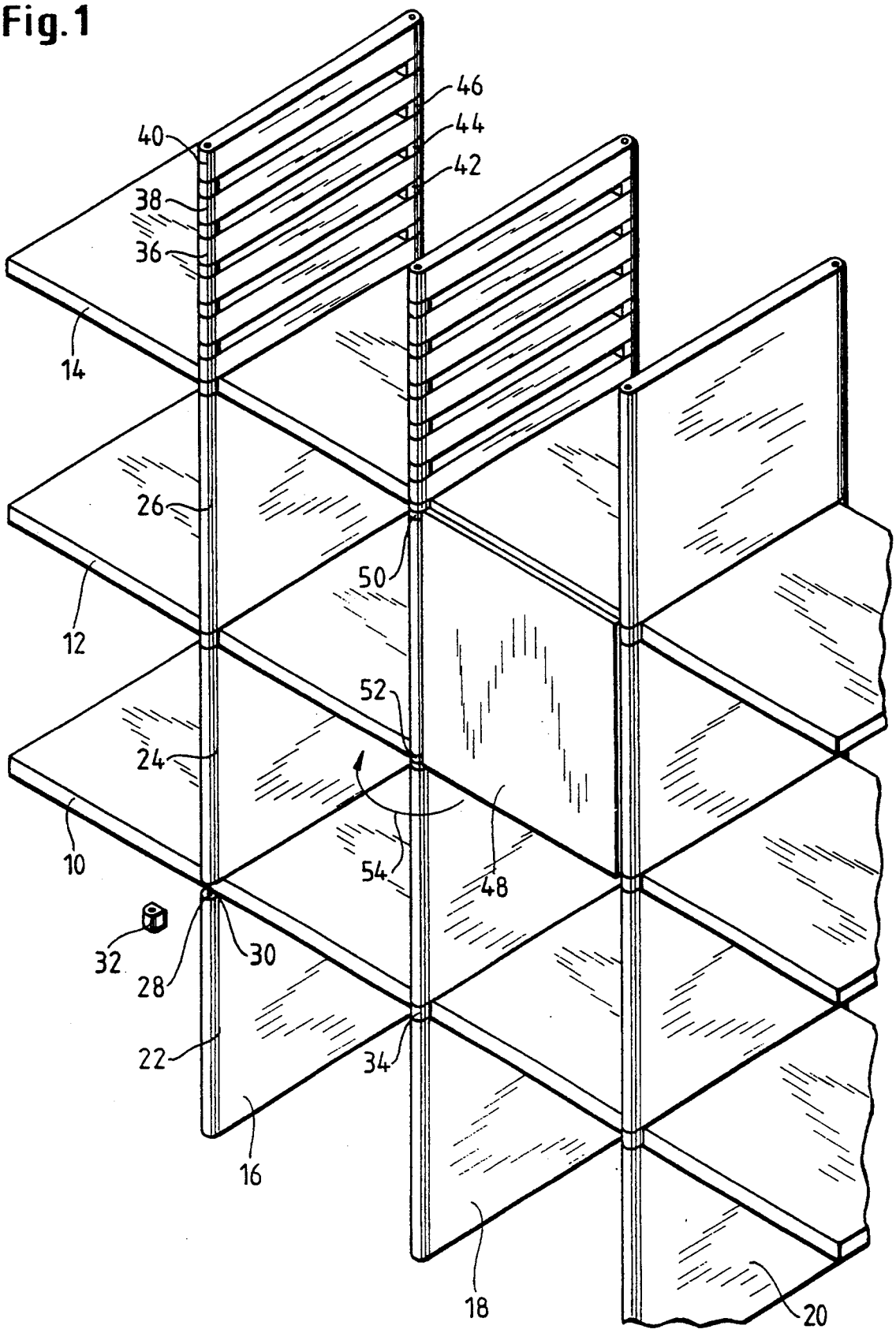
FIG. 1 is a perspective partial view of a shelf arrangement according to the invention.

FIG. 1 depicts a number of compartment base boards 10, 12, and 14 which extend horizontally over all compartments and project at both ends beyond the upright members.

The shelf arrangement shown in FIG. 1 includes three upright members 16, 18 and 20 composed of individual upright segments that are each interrupted by the through-going compartment base boards 10, 12 and 14. For example, the upright member 16 shown on the left in FIG. 1 has three plate-shaped upright segments 22, 24 and 26 which define superposed shelf compartments on the left side. Passages 28 to accommodate thin vertical rods 30 are disposed in the two vertical edges of upright segments 22, 24 and 26. In a manner of speaking, the upright segments are threaded onto the respective rods 30 at both lateral edges.

FIG. 1 shows that rods 30 remain visible at the height of the compartment bases since the upright segments 22 and 24 in FIG. 1 are spaced from one another by compartment base board 10. To bridge this distance, spacers 32 and 34 may be pushed onto the rods between successive upright segments. At the same time, spacers 32 and 34 have the effect that the compartment base boards disposed between the rods are additionally fixed.

It can thus be seen that a shelf arrangement can be assembled by the alternating assembly of compartment base boards and upright segments. Although tools are not required, the shelf arrangement becomes extremely stable so that it can also be placed in a free-standing arrangement. The width of the individual compartments is arbitrary and can be selected in infinite variations.

Instead of contiguous upright segments, the latter may be subdivided into individual strip-like elements 36, 38 and 40 between which further spacers 42, 44 and 46 are disposed. This configuration of the upright segments permits the accommodation of drawers as will be described in greater detail below.

FIG. 1 also shows, for the example of one compartment, a door plate 48 which closes the respective compartment. Hinge eyes 50 and 52 are provided at one vertical edge of this door plate. These hinge eyes can be pushed onto one of the rods adjacent to the compartment instead of two superposed spacers.

Figure 2:
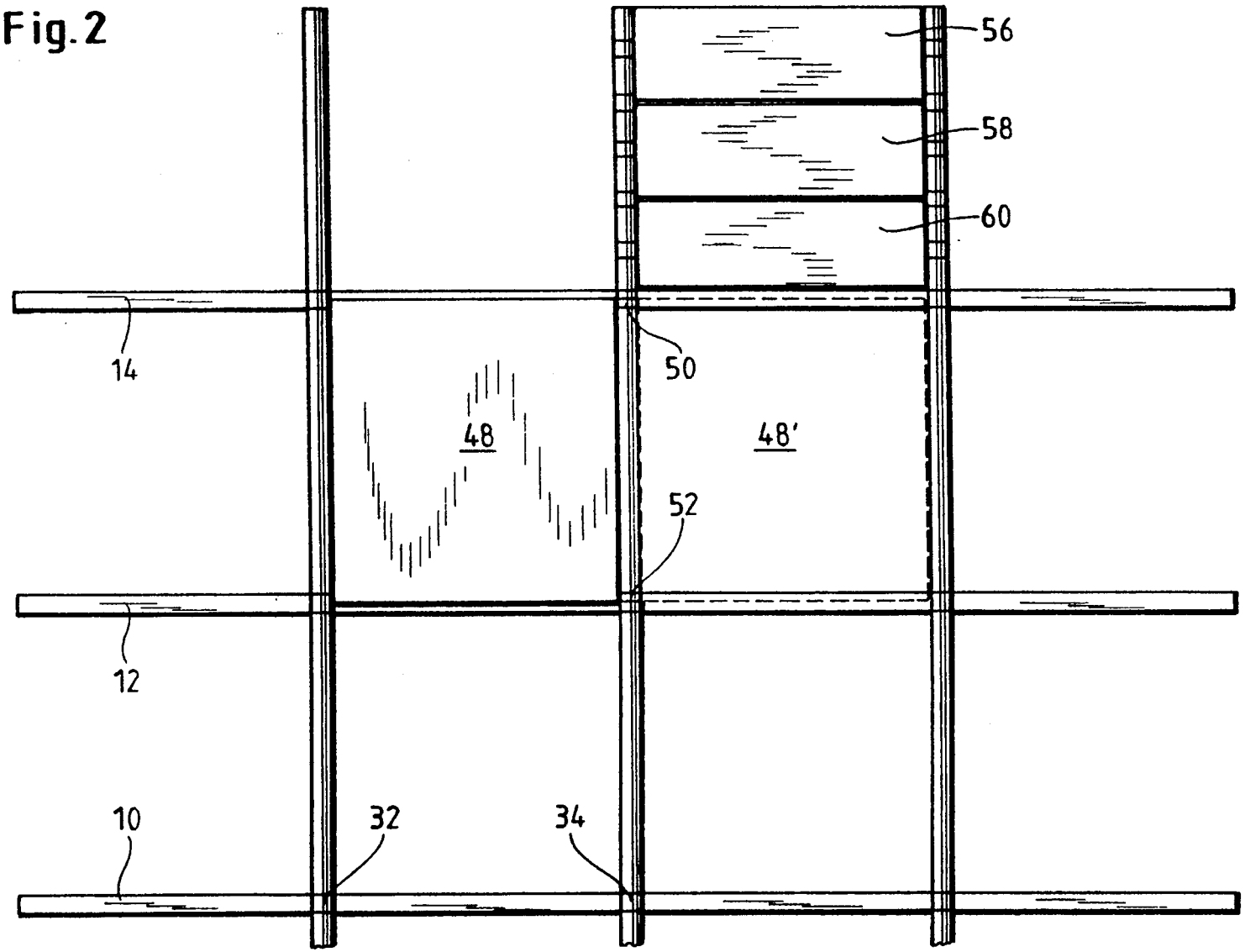
FIG. 2 is a sectional front view of a shelf arrangement according to the invention including a compartment door and a number of drawers.

FIG. 2 essentially corresponds to a front view of FIG. 1, but does contain a few slight deviations. On the one hand, it can be seen here that door plate 48 can be selectively employed, without disassembly, to close two adjacent compartments, if these compartments have been set to be the same size. FIG. 2 shows door plate 48 in front of the left compartment and door plate 48', in dashed lines, in front of the compartment adjacent thereto on the right. This pivoting movement between two adjacent compartments is indicated in FIG. 1 by an arrow 54.

Additionally, FIG. 2 shows three drawers 56, 58 and 60 which will be described in greater detail with reference to FIGS. 3 and 4.

Figure 3:
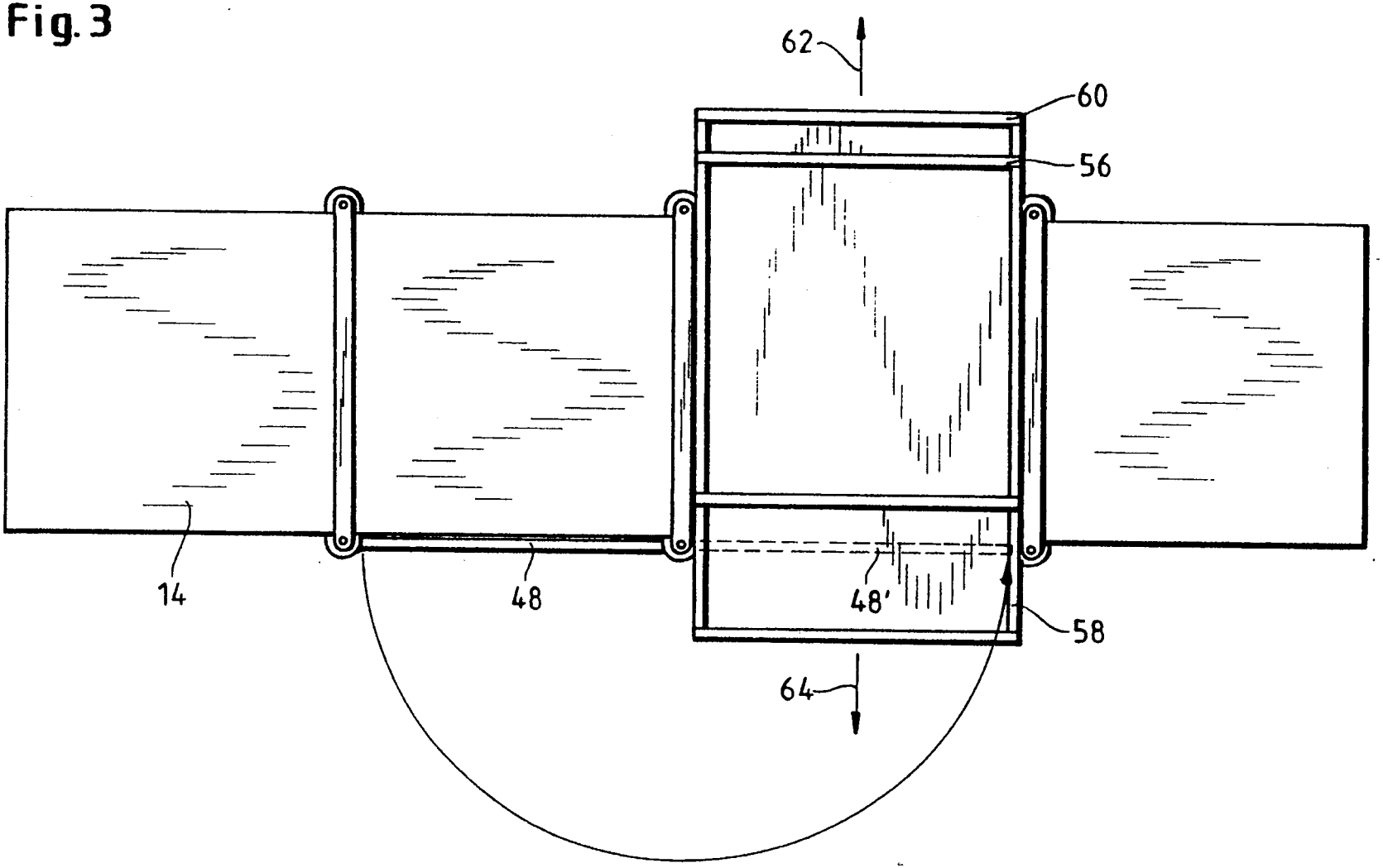
FIG. 3 is a top view of FIG. 2.
Figure 4:
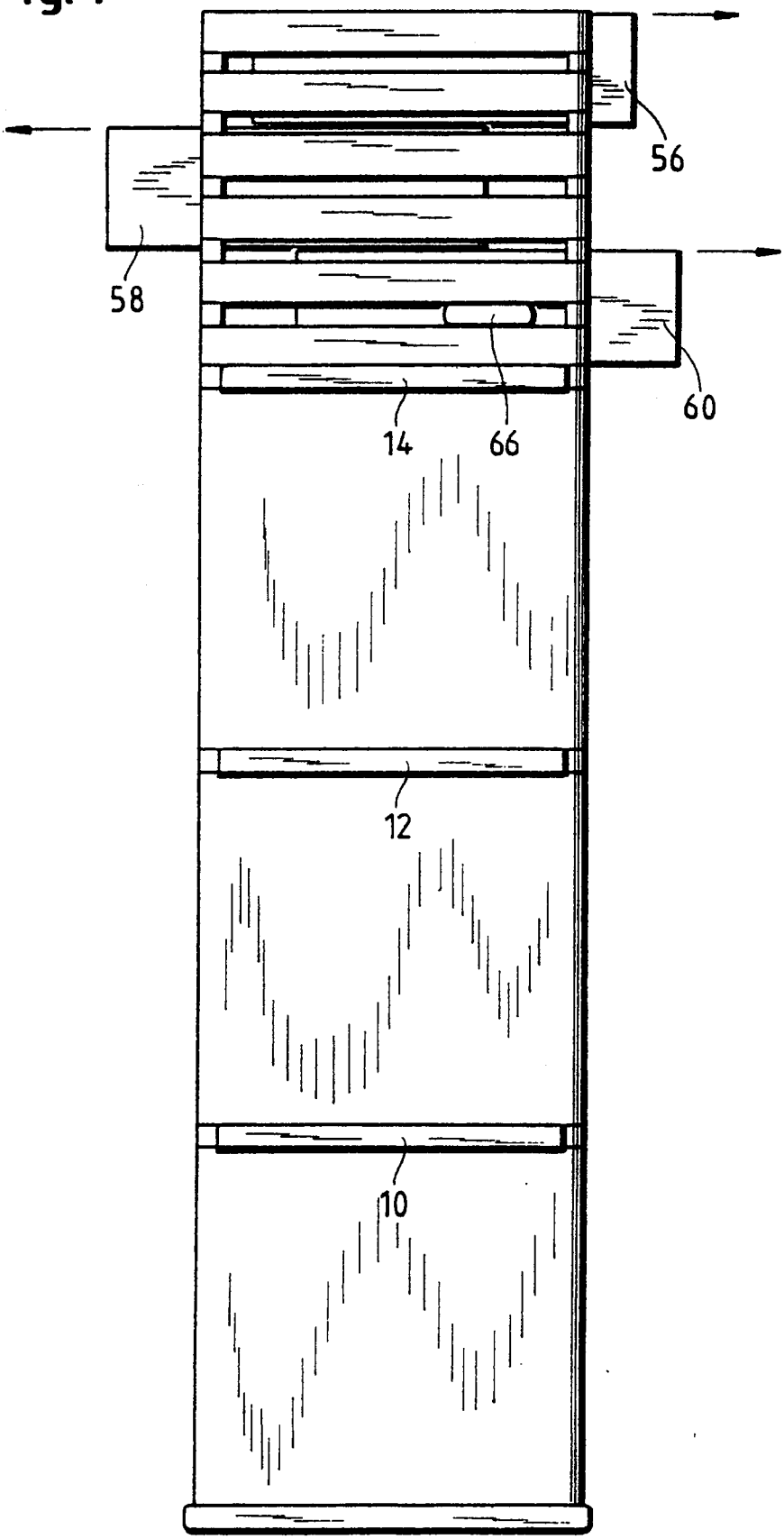
FIG. 4 is a side view of FIG. 2.

FIG. 3 essentially corresponds to a top view and FIG. 4 to a side view of the shelf arrangement of the preceding figures. The reference numerals of the preceding figures are therefore employed most of the time for the same or corresponding components.

FIG. 3 shows the three drawers 60 in various, partially pulled-out positions. The drawers may be pulled open in the same way from both sides of the shelf arrangement as shown by arrows 62 and 64. The corresponding guide mechanism is shown in FIG. 4 for the lower drawer 60. Horizontal, elongate guide blocks 66 are disposed on the two outer side walls of drawer 60 and are displaceable in the spaces between strip-like elements 36, 38 and 40. However, the extraction path is very limited if it is to be possible to pull the drawers out toward both sides and the guide blocks are fixed to the outer walls. It is therefore also possible to employ guide blocks 66 which are displaceable not only in the spaces between the strip-like elements but also in non-illustrated, corresponding grooves in the outer walls of the drawers. This creates the effect of a telescoping rail.

It will be understood that the above description of the present invention is susceptible to various modifications, changes and adaptations, and the same are intended to be comprehended within the meaning and range of equivalents of the appended claims.

What is claimed is:

1. A shelf kit for producing a shelf arrangement, said shelf arrangement having a height and further including:

a plurality of vertical upright members, said upright members being composed of a plurality of upright segments, each of said upright segments having a height, each of said upright segments further having a front end region and a rear end region, said front end region and said rear end region of each of said upright segments including vertical passages therein;

a plurality of compartment bases, each of said compartment bases having a length and a width; and a plurality of vertical rods, each of said vertical rods extending over the height of said shelf arrangement and being adapted to be received within said vertical passages;

said upright members and said compartment bases being adapted for forming said shelf compartments, each of said shelf compartments having a height and a length;

the height of each of said upright segments corresponding to the height of each of said shelf compartments;

the length of each of said compartment bases being longer than the length of each of said shelf compartments; and the front end region and the rear end region of each of said upright segments projecting beyond the compartment bases in a direction defined by the width of said compartment bases.

2. A shelf kit according to claim 1, further comprising spacers between said upright segments, said upright segments being adapted to have said vertical rods passing therethrough.

3. A shelf kit according to claim 1, wherein said upright segments are formed by individual strip-like elements that are spaced apart by spacers, said upright elements thereby including spaces formed between said strip-like elements.

4. A shelf kit according to claim 3, further comprising drawers, each of said drawers having two sides, each of said drawers further including guide blocks projecting at both sides thereof, said guide blocks being displaceably engaged in the spaces formed between said strip-like elements.

5. A shelf kit according to claim 4, wherein said drawers further include lateral grooves at both sides thereof, said guide blocks being displaceable within said lateral grooves.

6. A shelf kit according to claim 1, further comprising:

door plates for closing off individual shelf compartments, each of said door plates having an upper region and a lower region; and hinge rods disposed between two upright segments;

the upper region and the lower region of each of said door plates including lateral hinge eyes adapted to be placed onto a corresponding hinge rod.

* * * * *